US006532972B2

(12) United States Patent
Tarala

(10) Patent No.: US 6,532,972 B2
(45) Date of Patent: Mar. 18, 2003

(54) WASH WATER RECIRCULATION UNIT AND SYSTEM FOR KITCHEN VENTILATORS AND RELATED VENTILATION EQUIPMENT

(75) Inventor: H. James Tarala, Lake Oswego, OR (US)

(73) Assignee: Gaylord Industries, Inc., Tualatin, OR (US)

( * ) Notice: Subject to any disclaimer, the term of this patent is extended or adjusted under 35 U.S.C. 154(b) by 0 days.

(21) Appl. No.: 10/226,698

(22) Filed: Aug. 23, 2002

(65) Prior Publication Data

US 2002/0189645 A1 Dec. 19, 2002

Related U.S. Application Data

(62) Division of application No. 09/672,555, filed on Sep. 28, 2000, now Pat. No. 6,457,481.

(51) Int. Cl.[7] ..... B08B 3/02; F24C 15/20

(52) U.S. Cl. ..... 134/22.18; 134/169 R

(58) Field of Search ..... 134/56 R, 57 R, 134/107, 111, 166 R, 167 R, 168 R, 169 R, 22.18; 55/228; 126/299 E

(56) References Cited

U.S. PATENT DOCUMENTS

| | | | | | |
|---|---|---|---|---|---|
| 3,324,629 | A | * | 6/1967 | Graswich et al. | 55/87 |
| 3,751,885 | A | * | 8/1973 | McNeely | 55/267 |
| 3,785,124 | A | * | 1/1974 | Gaylord | 55/228 |
| 3,874,927 | A | * | 4/1975 | Willard, Sr. | |
| 4,753,218 | A | * | 6/1988 | Potter | 126/299 E |
| 5,069,197 | A | * | 12/1991 | Wisting | 126/299 E |
| 5,358,540 | A | * | 10/1994 | Tsan-Yun et al. | 55/227 |
| 5,456,842 | A | * | 10/1995 | Kibblehouse et al. | 210/649 |
| 5,472,342 | A | * | 12/1995 | Welsh, II et al. | 126/299 E |
| 5,593,598 | A | * | 1/1997 | McGinness et al. | 210/748 |
| 5,704,989 | A | * | 1/1998 | Page | 134/10 |
| 5,827,373 | A | * | 10/1998 | Eriksson | 134/10 |
| 5,849,100 | A | * | 12/1998 | Bowden | 134/10 |
| 5,851,305 | A | * | 12/1998 | Yamada et al. | 134/10 |
| 5,858,941 | A | * | 1/1999 | Oakes et al. | 510/179 |
| 5,860,412 | A | * | 1/1999 | Way | 134/169 R |

* cited by examiner

*Primary Examiner*—Philip Coe
(74) *Attorney, Agent, or Firm*—Thompson Hine LLP

(57) ABSTRACT

A wash water recirculation unit and system for use in cleaning ventilation system equipment, and components of the system, are described.

17 Claims, 4 Drawing Sheets

WASH WATER RECIRCULATION UNIT AND SYSTEM FOR KITCHEN VENTILATORS AND RELATED VENTILATION EQUIPMENT

CROSS-REFERENCE

This application is a divisional of application Ser. No. 09/672,555, filed Sep. 28, 2000 and now U.S. Pat. No. 6,457,481.

FIELD OF THE INVENTION

The present invention relates generally to exhaust systems used in commercial kitchens, and more particularly, to a wash water recirculation unit and system for use in cleaning ventilation system equipment such as ventilators and smoke pollution control units used in commercial kitchens.

BACKGROUND OF THE INVENTION

Kitchen ventilator hoods have long been provided for the purpose of exhausting steam, smoke and particulates such as grease which are produced in the commercial kitchen environment. It is common to periodically clean such ventilators using a combination of hot water and a cleaning agent by feeding the combined water/cleaning agent internally to the ventilator and thereafter disposing of the water/cleaning agent by feeding it to a drain. Other types of ventilation equipment such as smoke pollution control units are also periodically cleaned in the same manner. In large commercial kitchens the cost incurred as a result water and heat used for such cleaning operations can be significant.

SUMMARY OF THE INVENTION

As used herein the term "ventilation equipment" is intended to broadly encompass ventilators themselves as well as any other type of device or structure positioned along the exhaust path including, but not limited to, smoke pollution control units, grease exhaust duct work, grease exhaust duct sumps, and grease exhaust fans.

In one aspect, a method of cleaning ventilation equipment in commercial kitchens involves (a) providing a tank for holding a supply of heated wash liquid; (b) maintaining a temperature of the heated wash liquid in the tank at or above a threshold minimum temperature; (c) establishing a plurality of ventilation equipment cleaning stations; (d) performing the following steps for each ventilation equipment cleaning station: (i) delivering heated wash liquid from the tank to the ventilation equipment cleaning station; (ii) returning the heated wash liquid from the ventilation equipment cleaning station to the tank; wherein step (d) is performed for each ventilation equipment cleaning station in a sequenced manner.

In another aspect, a system for cleaning ventilation equipment in commercial kitchens includes a tank containing a supply of heated wash liquid, the tank including at least one outlet for transmitting heated wash liquid to a plurality of output lines. Each output line includes an associated flow control device for controlling a flow of heated wash liquid thereto, each output line connected for carrying heated wash liquid to a respective ventilation equipment cleaning station. A plurality of return lines carry wash liquid back from the ventilation equipment cleaning stations after the wash liquid has been delivered thereto so as to recirculate the wash liquid back to the tank for re-use. A controller is operable during a washing cycle to effect operation of the flow control devices such that wash liquid is delivered to the ventilation equipment cleaning stations in a sequenced manner.

A further aspect provides a method for controlling delivery of a recirculated wash liquid to a plurality of ventilation equipment cleaning stations. The method involves (a) providing a plurality of output lines, each output line leading to a respective ventilation equipment cleaning station; (b) providing a plurality of pressure operated valves, each pressure operated valve positioned for controlling flow of wash liquid to a respective output line; (c) providing a source of pressurized liquid; (d) providing a plurality of pilot lines, each pilot line positioned between the source of pressurized liquid and a control input of a respective pressure operated valve; wherein the pilot lines are placed in fluid communication with the pressurized fluid manifold to open the pressure operated valves, and wherein the pilot lines are taken out of fluid communication with the pressurized fluid manifold to close the pressure operates valves.

In yet another aspect, a system for maintaining a supply of heated wash liquid which is repeatedly used for cleaning ventilation equipment includes a tank for containing a supply of heated wash liquid and a temperature sensor for monitoring a temperature of the supply of wash liquid. A heating unit separate from the tank is provided. A heating unit input line delivers wash liquid from the tank to the heating unit and a heating unit output line delivers wash liquid from the heating unit back to the tank. A pump causes wash liquid to flow from the tank, through the heating unit input line, through the heating unit, through the heating unit output line, and back to the tank, wherein wash liquid is heated as it passes through the heating unit. A controller receives an output of the temperature sensor, controls the pump, and controls the heating unit. The controller may be operable to control the heating unit and the pump so as to maintain the temperature of the supply of wash liquid at or above a threshold temperature.

DETAILED DESCRIPTION OF THE EMBODIMENTS

Figure 1:
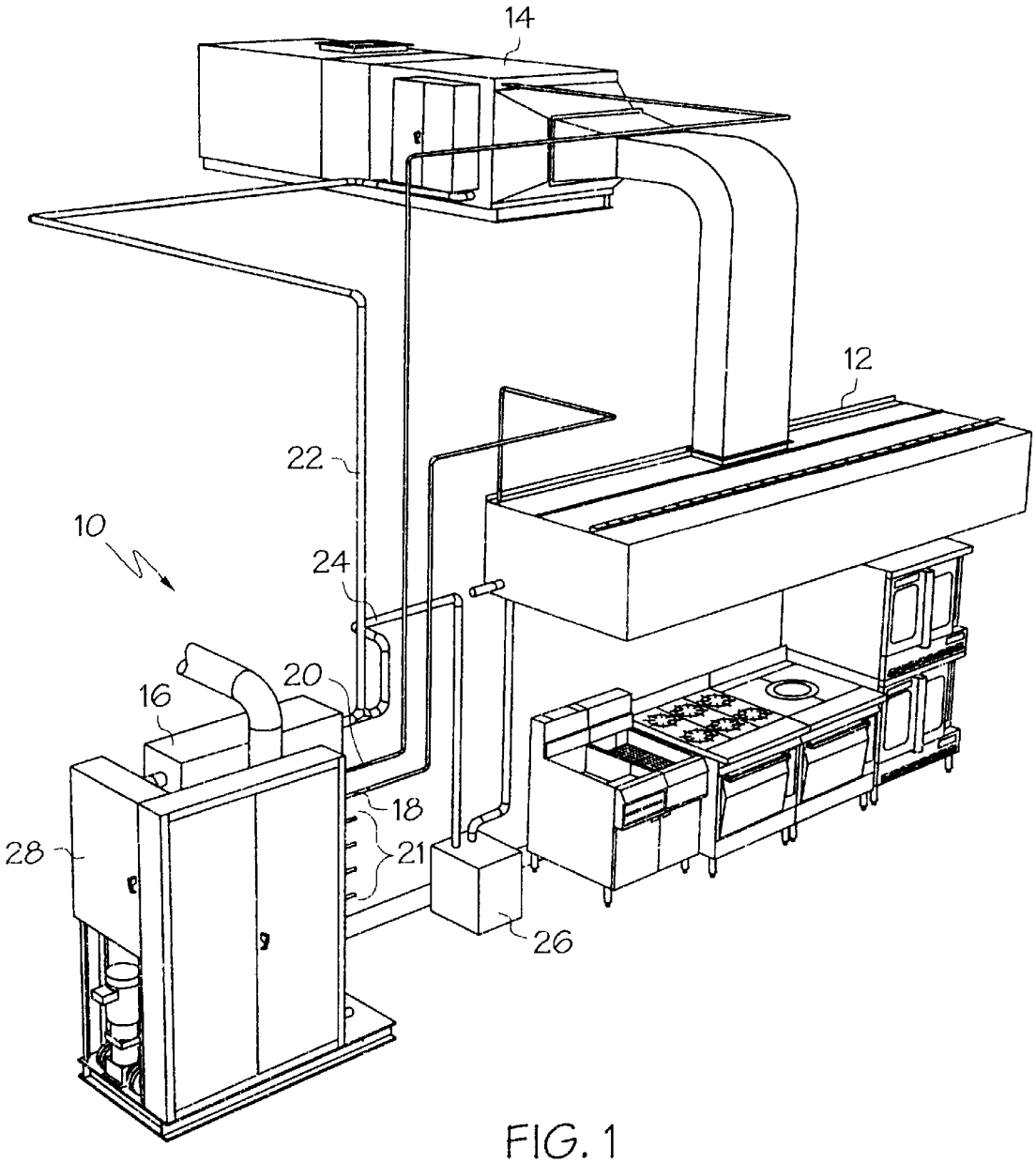
FIG. 1 is a perspective view of one embodiment of a system for cleaning ventilation equipment in a commercial kitchen.

Referring to drawing FIG. 1, one embodiment of a system 10 for cleaning ventilation equipment in a commercial kitchen is shown in perspective view. Two ventilation equipment devices, namely a ventilator 12 and a smoke pollution control unit 14 are shown. System 10 includes a tank 16 containing a supply of heated wash liquid. The tank may be insulated as desired to reduce heat losses to the surroundings. The tank 16 including at least one outlet for transmitting heated wash liquid to a plurality of output lines 18, 20. Although two output lines 18 and 20 are shown in use in the illustrated embodiment, additional output lines 21 may be provided for use as needed in a given installation.

Figure 2:
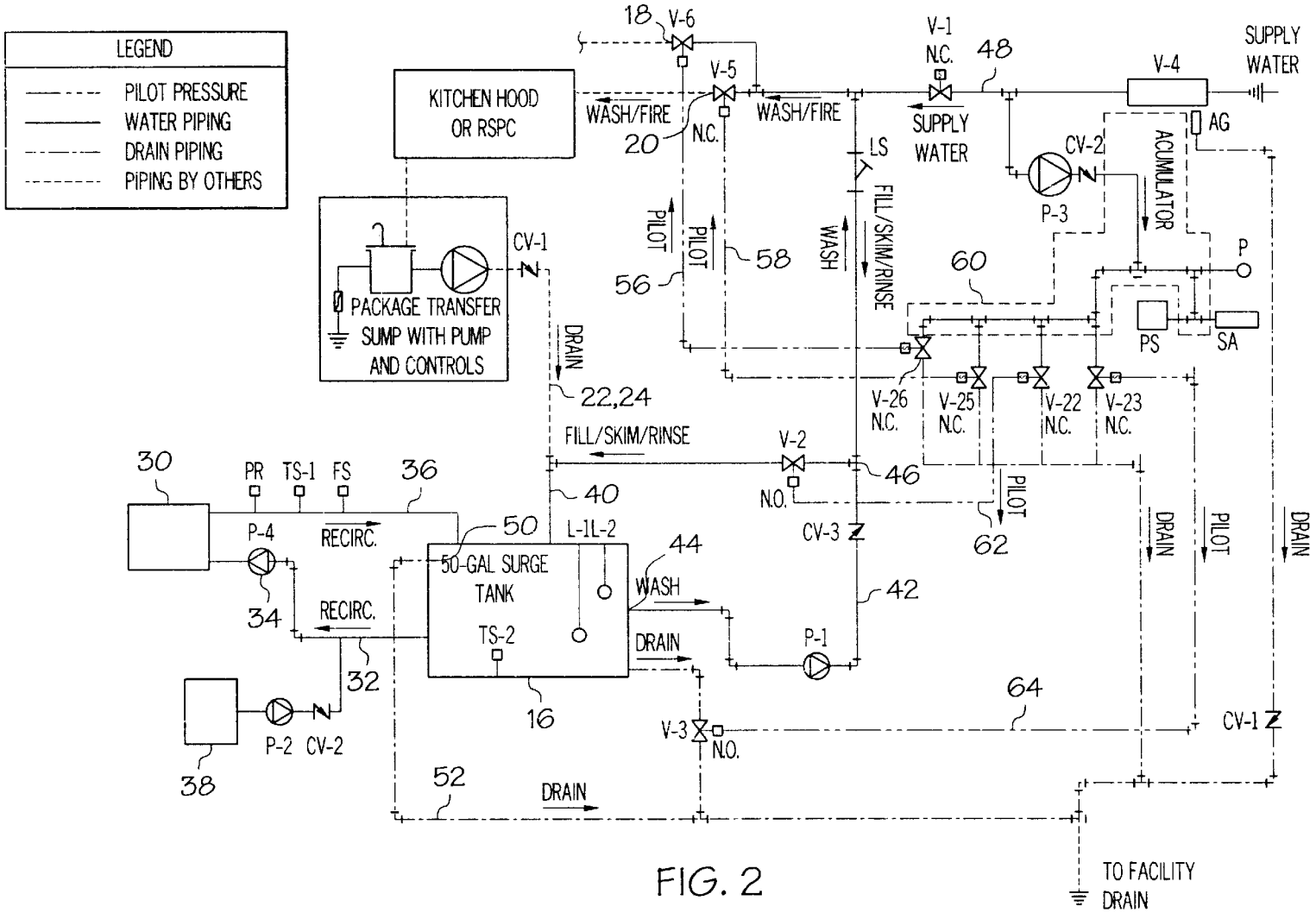
FIG. 2 is a schematic view of one arrangement of the system of FIG. 1.

As seen in the schematic of FIG. 2, each output line includes an associated flow control device V-6 and V-5 for controlling a flow of heated wash liquid thereto. In the illustrated embodiment a pump P-1 may be controlled to deliver wash liquid from a single output of the tank to each output line 18 and 20 through its respective flow control device V-6 and V-5 which are shown as flow control valves. However, it is recognized that each output line may have its own pump which would act as a flow control device for the output line, in which case each pump might be connected to a common output line of the tank, or a different output line from the tank for each pump might be provided.

Each output line 18 is connected for carrying heated wash liquid to a respective ventilation equipment cleaning station. In the illustrated embodiment (FIG. 1) each piece of ventilation equipment 12 and 14 represents a ventilation equipment cleaning station. However, it is recognized that a given piece of ventilation equipment, such as a large size ventilator, may include two more ventilation equipment cleaning stations such that more than one output line might be connected to a single piece of ventilation equipment.

A plurality of return lines 22 and 24 carry wash liquid back from the ventilation equipment cleaning stations after the wash liquid has been delivered thereto so as to recirculate the wash liquid back to the tank 16 for re-use. Gravity return lines may be used where possible, or forced return lines which include a pump 26 may be used if needed.

A controller 28 may be operable during a washing cycle to effect operation of the flow control valves V-5 and V-6 such that heated wash liquid is delivered to the ventilation equipment cleaning stations in a sequenced manner. In one embodiment of this sequenced operation wash liquid may be fed to one ventilation equipment cleaning station at a time, for a certain cleaning time period, and, once the cleaning operation for one ventilation equipment cleaning station is completed, delivery of wash liquid to that station is stopped and delivery of wash liquid to another station is started. In one embodiment, the cleaning time period for each ventilation equipment cleaning station may be the same. In another embodiment the cleaning time period for different ventilation equipment cleaning stations may be different according to anticipated level of cleaning needed for the different ventilation equipment cleaning stations.

The washing cycle may implemented on a timed basis or manually. Wash liquid may be delivered to all ventilation equipment cleaning stations during a single washing cycle, each time the washing cycle is run through. However, it is also possible that a given system may be set up to clean certain ventilation equipment cleaning stations daily and others more or less often. In many installations, the wash liquid may be re-used for multiple washing cycles, with the wash liquid being drained as necessary when the accumulation of oils and fats in the wash liquid reaches an undesired level.

The controller 28 may be of any suitable configuration desired, including an electric controller formed by relays and contacts, as well as an electronic controller or programmable logic controller, or any combination of the same.

Referring to the schematic of FIG. 2, a heating unit 30 is provided for heating the wash liquid. In the illustrated embodiment, the heating unit 30 is separate from the tank and a heating unit input line 32 provides wash liquid from the tank 16 to the heating unit 30 via operation of a pump P-4. A heating unit output line 36 provides wash liquid from the heating unit 30 back to the tank 16. Wash liquid is heated when the heating unit 30 is turned on and water is passed through the heating unit 30. In one embodiment the heating unit may be a gas-fired unit with a heat exchanger through which the wash liquid passes. However, it is recognized that other types of heating units may be used, including, but not limited to, electric type heating units or a steam heating converter. It is also recognized that heating units which are not separate from the tank 16 could be used in some systems.

A temperature sensor TS-2 is provided for monitoring the temperature of the supply of heated wash liquid. In the illustrated embodiment, the pump P-4 and heating unit 30 are operated to maintain a temperature of the supply of heated wash liquid within the tank 16 at or above a minimum temperature by circulating wash liquid from the tank 16, through the heating unit 30, and back to the tank 16. For example, when the temperature of the heated wash liquid falls below a threshold temperature, the pump P-4 and heating unit 30 maybe turned on to raise the temperature of the supply of wash liquid to a higher temperature. When the higher temperature is reached the pump P-4 and heating unit 30 may be turned off until the temperature of the supply of wash liquid agin falls below the threshold temperature. In one embodiment the threshold temperature maybe in the range of 130° F.–150° F., and the higher temperature maybe at least 170° F., 175° F., or 180° F. In other embodiments such temperatures may be different. By maintaining the temperature of the wash liquid at a sufficiently high level, undesired bacterial growth in the system can be prevented and cleaning is facilitated. Further, in one embodiment the temperature of the wash liquid may be maintained at high enough level so that animal fats are maintained in a liquified state so as to prevent clogging of the system.

In the illustrated embodiment of FIG. 2, a supply of cleaning solution 38 is provided along with a pump P-2 is provided for controllably injecting cleaning solution into the heating unit input line 32 to create a wash liquid which is a combination of cleaning solution and water. The cleaning solution may be a colloidal agent. In this regard, although the use of such cleaning fluid is preferred, it is recognized that in some systems it may not be necessary. Accordingly, as used herein the term "wash liquid" is intended to broadly defined as any liquid which is delivered to cleaning stations for the purpose of cleaning. A check valve CV-2 may be provided for preventing back flow of wash liquid into the supply of cleaning solution 38.

In the illustrated embodiment, the heating unit output line 36 includes a pressure relief valve PR to limit any pressure build up which might be caused by heating of the wash liquid in the heating unit 30. A temperature sensor TS-1 is also provided and maybe used as a limiter to assure that the heating unit 30 does not heat the water to an unacceptably high temperature. A flow switch FS may be used to verify that wash liquid is flowing when the heating unit 30 is operating in order to avoid undesired overheating of the heating unit 30.

The tank 16 of the illustrated embodiment includes a level detector L-1 for determining if a level of wash liquid in the tank 16 falls below a predetermined low level, and an upper level detector L-2 for determining if a level of wash liquid in the tank 16 reaches a predetermined high level. The level detectors may be float switches or any other type of level detector. An input line 40 to the tank includes an associated flow control device such as a flow control valve V-2.

In the illustrated embodiment, a common line 42 carries wash liquid from the tank outlet 44 to each flow control device V-6 and V-5 and its associated output line 18 and 20. The input line 40 is connected to the common line 42 at a connection location 46 to receive liquid from the common line 42. The common line 42 is connected to receive supply water from a supply line 48 through a flow control device V-1 which may be a flow control valve. The common line 42 may include a flow limiting valve such as a check valve CV-3 for preventing back flow of liquid along the common line 42 into the tank 16. The flow limiting valve CV-3 is positioned between the connection location 46 and the tank outlet 44. in this arrangement, during a fill operation of the tank 16, the output line flow control devices V-5 and V-6 are used to prevent flow to the output lines 20 and 18, the input line flow control device V-2 is used to permit flow along the input line 40, and the supply line flow control device V-1 is used to permit flow to the common line 42, thus delivering water from the supply line 48 to the tank 16. During delivery of wash liquid to the output lines in the washing cycle, the input line flow control device V-2 is used to prevent flow between the common line 42 to the input line 40 and the supply line flow control device V-1 is used to prevent flow from the common line 42 back into the supply line 48.

In the illustrated embodiment, the supply line 48 connects to an external supply of water through a reduced pressure back flow preventer V-4. A line strainer LS may also be provided along common line 42 to prevent flow of large debris to the output line flow control devices V-6 and V-5. The line strainer may be a 60-mesh screen type line strainer.

In one embodiment of a fill operation of the tank, water is fed into the tank until the predetermined high level of the tank (such as detected by L-2) is reached. Water delivery to the tank 16 via the input line 40 is continued for a set time period (such as several minutes for example) causing the level of liquid within the tank to overflow out of an overflow outlet 50 of the tank. The overflow outlet 50 may be connected to a drain line 52. This type of fill operation is used as a skim type fill operation to remove suds from the tank 16 which may occur near the water surface when cleaning solution is added to the tank 16.

In one washing cycle embodiment, during the washing cycle, if the level of wash liquid in the tank 16 falls below a predetermined low level (such as the level detected by L-1), delivery of wash liquid to ventilation equipment cleaning stations is temporarily suspended while additional water is introduced into the tank using the flow control device V-2 associated with the tank inlet line 40.

In another washing cycle embodiment, during the washing cycle, if the temperature of the supply of heated wash liquid falls below a predetermined temperature, delivery of the wash liquid to ventilation equipment cleaning stations is temporarily suspended while the heating unit is operated to bring the temperature of the supply of heated wash liquid back up to the predetermined temperature.

In one heating cycle embodiment, during the heating cycle, if the level of wash liquid in the tank 16 falls below a predetermined low level (such as the level detected by L-1), delivery of wash through the heating unit is temporarily suspended while additional water is introduced into the tank using the flow control device V-2 associated with the tank inlet line 40.

Figure 3:
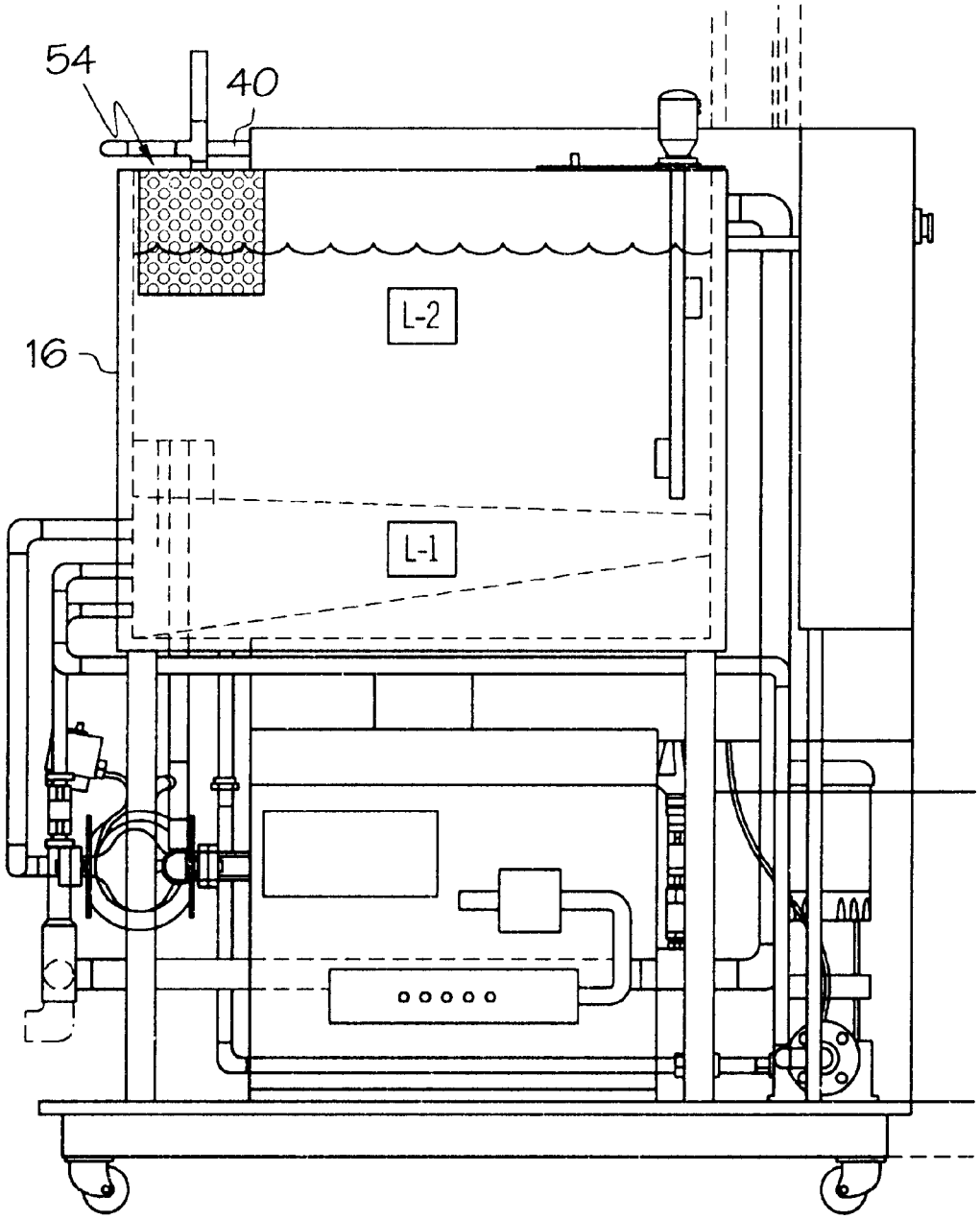
FIG. 3 is a rear elevation of a unit containing various aspects of the system.
Figure 4:
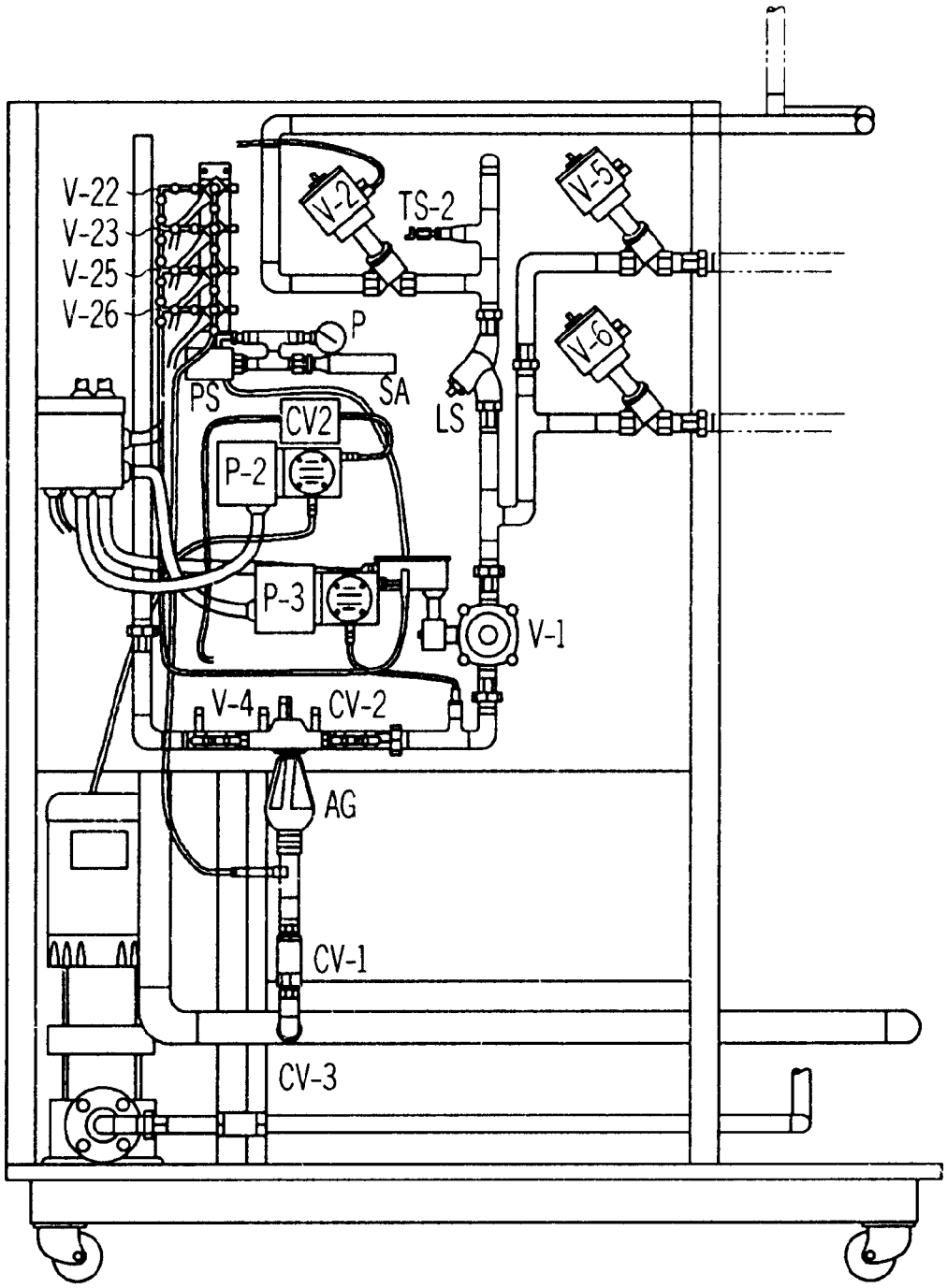
FIG. 4 is a front elevation of the unit of FIG. 3.

In the illustrated embodiment, each of the return lines 22, 24 connects to the input line 40 of the tank 16. As shown in the rear elevation of FIG. 3, the input line 40 feeds into a debris screening member 54 through which the return wash liquid passes. The debris screening member 54 may be as simple as a perforated basket which prevents debris from enter the supply of wash water.

Referring again to FIG. 2, the illustrated embodiment for controlling delivery of the recirculated wash liquid to the ventilation equipment cleaning stations uses the output lines 18 and 20 which receive the recirculated wash liquid, and run to respective ventilation equipment cleaning stations. In one embodiment the flow control devices V-6 and V-5 are pressure controlled valves (such as normally closed bronze piston valves available from ASCO as part # 8290A010—or any other pressure operated valve), each pressure controlled valve V-6 and V-5 associated with a respective output line 18 and 20. In one example, the pressure controlled valves may be piston valves. Pilot lines 56 and 58 are each connected to a control input of a respective pressure controlled valve V-6 and V-5. A pressurized liquid manifold 60 is provided to supply pressurized liquid to the pilot lines 56 and 58. Electrically controlled valves V-26 and V-25 (such as 3-way solenoid valves) are provided, with each valve V-26 and V-25 positioned between the pressurized liquid manifold 60 and a respective pilot line 56 and 58 for controlling delivery of pressurized liquid to the pilot line. The controller (not shown) connects to the electrically controlled valves for operating or energizing the same.

In the illustrated embodiment of the pressurized liquid manifold 60 the manifold includes a shock absorber SA (such as available from Sioux Chief under part # SC-652A or similar unit) which is pressurized for assisting in maintaining an adequate pressure level in the manifold 60 when one or more of the electrically controlled valves is opened. A pump P-3 has an output which feeds the pressurized liquid manifold 60, and an input of the pump P-3 is connected to water supply line 48. A pressure sensor PS is associated with the pressurized liquid manifold 60 and triggers operation of the pump P-3 when a pressure within the manifold falls below a threshold minimum level. A check valve CV-2 may be positioned between the pump output and the pressurized liquid manifold 60 for preventing back flow of liquid from the manifold 60 to the pump P-3.

In the illustrated embodiment, the controller 28 (FIG. 1) is connected for controlling the open/closed state of each of the electrically controlled valves V-26 and V-25 and, during a washing cycle, the controller 28 is operable to open each electrically controlled valve V-26 and V-25 to deliver pressurized fluid to its respective pilot line 566 or 58 causing the pilot line's associated pressure operated valve V-6 or V-5 to open. In one embodiment of the washing cycle the controller 28 may be operable to sequentially open one electrically controlled valve V-26 and V-25 at a time during the washing cycle.

In the illustrated embodiment the input line flow control device V-2 may also be a pressure operated valve having an associated pilot line 62 connected to the valve's control input, with an electrically controlled valve V-22 connected to control deliver of pressurized liquid from the manifold 60 to the pilot line 62.

Similarly, a drain flow control device V-3 may also be a pressure operated valve having an associated pilot line 64 connected to the valve's control input, with an electrically controlled valve V-23 connected to control deliver of pressurized liquid from the manifold 60 to the pilot line 64. In one embodiment the pressure regulated valve V-3 may be a normally-open type valve which is held closed via energization ov valve V-23. In this arrangement loss of power to the system will cause the tank 16 to drain while the wash liquid is still hot.

In one embodiment of a method of cleaning ventilation equipment in commercial kitchens, the method involves (a) providing a tank for holding a supply of heated wash liquid; (b) maintaining a temperature of the heated wash liquid in the tank at or above a threshold minimum temperature; (c) establishing a plurality of ventilation equipment cleaning stations; (d) performing the following steps for each ventilation equipment cleaning station: (i) delivering heated wash liquid from the tank to the ventilation equipment cleaning station; (ii) returning the heated wash liquid from the ventilation equipment cleaning station to the tank; wherein step (d) is performed for each ventilation equipment cleaning station in a sequenced manner.

In one embodiment of a method for controlling delivery of a recirculated wash liquid to a plurality of ventilation equipment cleaning stations, the method involves: (a) providing a plurality of output lines, each output line leading to a respective ventilation equipment cleaning station; (b) providing a plurality of pressure operated valves, each pressure operated valve positioned for controlling flow of wash liquid to a respective output line; (c) providing a source of pressurized liquid; (d) providing a plurality of pilot lines, each pilot line positioned between the source of pressurized liquid and a control input of a respective pressure operated valve; wherein the pilot lines are placed in fluid communication with the pressurized fluid manifold to open the pressure operated valves, and wherein the pilot lines are taken out of fluid communication with the pressurized fluid manifold to close the pressure operates valves.

Although the invention has been described and illustrated in detail it is to be clearly understood that the same is intended by way of illustration and example only and is not intended to be taken by way of limitation. Accordingly, the spirit and scope of the invention are to be limited only by the terms of the appended claims.

What is claimed is:

1. A system for controlling delivery of a recirculated wash liquid to a plurality of ventilation equipment cleaning stations, the system comprising:

a plurality of output lines for receiving the recirculated wash liquid, each line running to a respective ventilation equipment cleaning station;

a plurality of pressure controlled valves, each pressure controlled valve associated with a respective output line;

a plurality of pilot lines, each pilot line connected to a control input of a respective pressure controlled valve;

a pressurized liquid manifold for providing pressurized liquid to the pilot lines; and a plurality of electrically controlled valves, each electrically controlled valve positioned between the pressurized liquid manifold and a respective pilot line for controlling delivery of pressurized liquid to the pilot line.

2. The system of claim 1 wherein the pressurized liquid manifold includes a shock absorber which is pressurized for assisting in maintaining an adequate pressure level in the manifold when one or more of the electrically controlled valves is opened.

3. The system of claim 2, further comprising:

a pump with an output which feeds the pressurized liquid manifold, an input of the pump connected to a water supply line.

4. The system of claim 3 further comprising a pressure sensor associated with the pressurized liquid manifold, the pressure sensor triggering operation of the pump when a pressure within the manifold falls below a threshold minimum level.

5. The system of claim 3 further comprising a check valve positioned between the pump output and the pressurized liquid manifold for preventing back flow of liquid from the manifold to the pump.

6. The system of claim 1, further comprising:

a controller connected for controlling the open/closed state of each of the electrically controlled valves, wherein, during a washing cycle, the controller is operable to open each electrically controlled valve to deliver pressurized fluid to its respective pilot line causing the pilot line's associated pressure operated valve to open.

7. The system of claim 6 wherein the controller is operable to sequentially open one electrically controlled valve at a time during the washing cycle.

8. A method for controlling delivery of a recirculated wash liquid to a plurality of ventilation equipment cleaning stations, the method comprising the steps of:

(a) providing a plurality of output lines, each output line leading to a respective ventilation equipment cleaning station;

(b) providing a plurality of pressure operated valves, each pressure operated valve positioned for controlling flow of wash liquid to a respective output line;

(c) providing a source of pressurized liquid;

(d) providing a plurality of pilot lines, each pilot line positioned between the source of pressurized liquid and a control input of a respective pressure operated valve; and wherein the pilot lines are placed in fluid communication with the pressurized liquid source to open the pressure operated valves, and wherein the pilot lines are taken out of fluid communication with the pressurized liquid source to close the pressure operated valves.

9. The method of claim 8 comprising the further step of:

(e) initiating a wash cycle during which each pilot line is placed in fluid communication with the pressurized liquid source for a certain time period, with only one pilot line placed in fluid communication with the pressurized liquid source at any one time.

10. A system for controlling delivery of a wash liquid to a ventilation equipment cleaning station, the system comprising:

a wash liquid path for receiving the wash liquid and carrying the wash liquid to a ventilation equipment cleaning station;

a pressure controlled valve associated with the wash liquid path for controlling flow of wash liquid along the wash liquid path;

a pilot line connected to a control input of the pressure controlled valve;

a pressurized liquid source for providing pressurized liquid to the pilot line; and an electrically controlled valve positioned between the pressurized liquid source and the pilot line for controlling delivery of pressurized liquid to the pilot line to effect control of the pressure controlled valve.

11. The system of claim 10 wherein the pressurized liquid source includes a shock absorber that is pressurized for assisting in maintaining an adequate pressure level at the source when the electrically controlled valve is opened.

12. The system of claim 11, further comprising:

a pump with an output that feeds the pressurized liquid source, an input of the pump connected to a water supply line.

13. The system of claim 12 further comprising a check valve positioned between the pump output and the pressurized liquid source for preventing back flow of liquid from the source to the pump.

14. The system of claim 11 further comprising a pressure sensor associated with the pressurized liquid source, the pressure sensor triggering operation of the pump when a pressure of the source falls below a threshold minimum level.

15. The system of claim 10, further comprising:

a controller connected for controlling the open/closed state of the electrically controlled valve.

16. The system of claim 10 wherein the wash liquid path extends from a tank containing the wash liquid, and the system further comprises a wash liquid return path extending from the ventilation equipment cleaning station back to the tank for returning the wash liquid to the tank.

17. A method for controlling delivery of a wash liquid from a tank to a ventilation equipment cleaning station, the method comprising the steps of:

(a) providing an output line leading to a ventilation equipment cleaning station;

(b) providing a pressure operated valve positioned for controlling flow of wash liquid along the output line;

(c) providing a source of pressurized liquid;

(d) providing a pilot line extending from the source of pressurized liquid to a control input of the pressure operated valve; and wherein the pilot line is placed in fluid communication with the pressurized liquid source to open the pressure operated valve, and wherein the pilot line is taken out of fluid communication with the pressurized liquid source to close the pressure operated valve.

* * * * *